US011796147B1

(12) United States Patent
Liang

(10) Patent No.: US 11,796,147 B1
(45) Date of Patent: Oct. 24, 2023

(54) SOLAR POWERED FLAG LIGHT

(71) Applicant: Guangzhou Beiderui Musical Instrument Co., LTD, Guangzhou (CN)

(72) Inventor: Xiaoyan Liang, Guangzhou (CN)

( * ) Notice: Subject to any disclaimer, the term of this patent is extended or adjusted under 35 U.S.C. 154(b) by 0 days.

(21) Appl. No.: 17/939,964

(22) Filed: Sep. 8, 2022

(51) Int. Cl.

| | |
|---|---|
| ***F21S 9/03*** | (2006.01) |
| ***F21V 21/116*** | (2006.01) |
| ***G09F 17/00*** | (2006.01) |
| ***F21V 33/00*** | (2006.01) |
| ***F21W 131/10*** | (2006.01) |

(52) U.S. Cl.
CPC ..... *F21S 9/037* (2013.01); *F21V 21/116* (2013.01); *F21V 33/00* (2013.01); *G09F 17/00* (2013.01); *F21W 2131/10* (2013.01)

(58) Field of Classification Search
CPC ..... F21S 9/032; F21S 9/035; F21V 21/116; F21V 33/00; G09F 17/00; F21W 2131/10
USPC ..... 362/183
See application file for complete search history.

(56) References Cited

U.S. PATENT DOCUMENTS

2010/0288897 A1* 11/2010 Chang ..... G09F 7/18 248/229.2
2011/0242819 A1* 10/2011 Mitchell ..... F21S 9/037 362/311.01
2014/0211459 A1* 7/2014 Toner ..... F21V 33/00 362/396
2015/0009659 A1* 1/2015 Werner ..... F21K 9/20 362/183

FOREIGN PATENT DOCUMENTS

CN 106907688 A * 6/2017

* cited by examiner

*Primary Examiner* — Lau K Tso

(57) ABSTRACT

A solar powered flag light includes a fixing module, a solar powered panel module and a lighting module. The fixing module includes a first mounting portion, a second mounting portion, and at least one connection portion. The first mounting portion and the second mounting portion are configured to be disposed on two opposite sides of a flagpole. The at least one connection portion is configured to connect between the first mounting portion and the second mounting portion, such that the first mounting portion and the second mounting portion can clamp the flagpole to fix the solar powered flag light on the flagpole. The solar powered panel module is configured to be disposed on the first mounting portion. The lighting module is configured to be disposed on the second mounting portion.

16 Claims, 4 Drawing Sheets

SOLAR POWERED FLAG LIGHT

TECHNICAL FIELD

The present disclosure relates to the field of solar powered lighting devices, in particular to a solar powered flag light and a solar powered light.

BACKGROUND

It has always been a sign of patriotism to display the flag at one's home or place of business. The desire to display the flag has been heightened in recent years. Proper flag etiquette requires that an American flag be displayed only during daylight hours unless the flag is properly illuminated after dark. In other words, the flag must be hoisted up a flag pole at dawn and retrieved at dusk unless the flag is properly illuminated.

Traditionally, A/C electrically powered lights are mounted at the base of a flag pole or even on the pole and directed upwardly toward the flag. Although assumably effective for their intended purposes, the existing lighting devices for illuminating a flag include installation of electrical wiring to or adjacent to a flag pole and mounting upward directional lighting from a ground surface. Alternatively, battery powered lights mounted to the finial of the flag pole may be installed. In addition, solar powered lights mounted atop a flag pole have been proposed in order to avoid the ongoing cost of electric lighting.

However, how to fix a solar powered light stably on a flag or a pole is an important subject.

SUMMARY

The present disclosure provides a solar powered light which can be fixed on a flag or a pole stably.

The present disclosure adopts the following technical solution: a solar powered flag light including a fixing module including a first mounting portion, a second mounting portion, and at least one connection portion, the first mounting portion and the second mounting portion configured to be disposed on two opposite sides of a flagpole, and the at least one connection portion configured to connect between the first mounting portion and the second mounting portion such that the first mounting portion and the second mounting portion clamp the flagpole to fix the solar powered flag light on the flagpole; a solar powered panel module configured to be disposed on the first mounting portion; and a lighting module configured to be disposed on the second mounting portion, the lighting module electrically connected to the solar powered panel module such that the solar powered panel module is able to supply the lighting module.

Further, the at least one connection portion includes at least one first connection portion and at least one second connection portion, the at least one first connection portion is configured to connect a first end of the first mounting portion and a second end of the second mounting portion, the at least one second connection portion is configured to connect a third end of the first mounting portion opposite to the first end and a fourth end of the second mounting portion opposite to the second end, such that the flagpole is located between the at least one first connection portion and the at least one second connection portion.

Further, each of the at least one first connection portion and the at least one second connection portion includes a screw and a nut, the first mounting portion includes a first through hole located at the first end and a third through hole located at the third end, the second mounting portion includes a second through hole located at the second end and a fourth through hole located at the fourth end, the screw of the at least one first connection portion is configured to pass through the first through hole and the second through hole, and the nut of the at least one first connection portion is configured to fixed at an end the screw of the at least one first connection portion; the screw of the at least one second connection portion is configured to pass through the third through hole and the fourth through hole, and the nut of the at least one second connection portion is configured to fixed at an end the screw of the at least one second connection portion.

Further, a number of the at least one first connection portion is two, and a number of the at least one second connection portion is two.

Further, the first mounting portion includes a first main board, a first connection board connected between the first end and the first main board, and a second connection board connected between the third end and the first main board, the second mounting portion includes a second main board configured to face with the first main board, a third connection board connected between the second end and the second main board, and a fourth connection board connected between the fourth end and the second main board, a first distance between the first end and the second end is configured to be less than a distance between the first main board and the second main board, a second distance between the third end and the fourth end is configured to be less than the distance between the first main board and the second main board and be equal to the first distance.

Further, an angle between the first main board and the first connection board is a first obtuse angle, an angle between the first main board and the second connection board is a second obtuse angle, an angle between the first end and the first connection board is a third obtuse angle, an angle between the third end and the first connection board is a fourth obtuse angle, an angle between the second main board and the third connection board is a fifth obtuse angle, an angle between the second main board and the fourth connection board is a sixth obtuse angle, an angle between the second end and the third connection board is a seventh obtuse angle, an angle between the fourth end and the fourth connection board is an eighth obtuse angle, the first, second, third, fourth, fifth, sixth, seventh, and eighth obtuse angle have the same degrees.

Further, the solar powered panel module includes a solar panel, a first fixing element, and a second fixing element, an end of the first fixing element is rotatably connected with and end of the solar panel, the other end of the first fixing element is connected with the first main board; an end of the second fixing element is rotatably connected with the other end of the solar panel, the other end of the second fixing element is connected with the first main board.

Further, each of the first fixing element and the second fixing element includes a first part configured to be disposed on the first main board and a second part vertically connected with the first part and rotatably connected with the solar panel.

Further, the lighting module includes a third fixing element disposed on the second main board and a light rotatably connected with the third fixing element.

Further, the third fixing element includes a base board installed on the second main board, a first extending board connected with the base board, and a second extending board connected with the base board, the second extending board faces with the first extending board, and two opposite sides of the light are rotatably connected with the first extending board and the second extending board respectively.

The present disclosure also adopts the following technical solution: a solar powered light including a fixing module including a first mounting portion, a second mounting portion, and at least one connection portion, the first mounting portion and the second mounting portion configured to be disposed on two sides of a pole, and the at least one connection portion configured to connect between the first mounting portion and the second mounting portion such that the first mounting portion and the second mounting portion clamp the pole to fix the solar powered light on the pole; a solar powered panel module configured to be mounted on the first mounting portion; and a lighting module configured to be mounted on the second mounting portion, the lighting module electrically connected to the solar powered panel module such that the solar powered panel module is able to supply the lighting module.

Further, the at least one connection portion includes at least one first connection portion and at least one second connection portion, the at least one first connection portion is configured to connect a first end of the first mounting portion and a second end of the second mounting portion, the at least one second connection portion is configured to connect a third end of the first mounting portion opposite to the first end and a fourth end of the second mounting portion opposite to the second end, such that the pole is located between the at least one first connection portion and the at least one second connection portion.

Further, each of the at least one first connection portion and the at least one second connection portion includes a screw and a nut, the first mounting portion includes a first through hole located at the first end and a third through hole located at the third end, the second mounting portion includes a second through hole located at the second end and a fourth through hole located at the fourth end, the screw of the at least one first connection portion is configured to pass through the first through hole and the second through hole, and the nut of the at least one first connection portion is configured to fixed at an end the screw of the at least one first connection portion; the screw of the at least one second connection portion is configured to pass through the third through hole and the fourth through hole, and the nut of the at least one second connection portion is configured to fixed at an end the screw of the at least one second connection portion.

Further, a number of the at least one first connection portion is two, and a number of the at least one second connection portion is two.

Further, the first mounting portion includes a first main board, a first connection board connected between the first end and the first main board, and a second connection board connected between the third end and the first main board, the second mounting portion includes a second main board configured to face with the first main board, a third connection board connected between the second end and the second main board, and a fourth connection board connected between the fourth end and the second main board, a first distance between the first end and the second end is configured to be less than a distance between the first main board and the second main board, a second distance between the third end and the fourth end is configured to be less than the distance between the first main board and the second main board and be equal to the first distance.

Further, an angle between the first main board and the first connection board is a first obtuse angle, an angle between the first main board and the second connection board is a second obtuse angle, an angle between the first end and the first connection board is a third obtuse angle, an angle between the third end and the first connection board is a fourth obtuse angle, an angle between the second main board and the third connection board is a fifth obtuse angle, an angle between the second main board and the fourth connection board is a sixth obtuse angle, an angle between the second end and the third connection board is a seventh obtuse angle, an angle between the fourth end and the fourth connection board is an eighth obtuse angle, the first, second, third, fourth, fifth, sixth, seventh, and eighth obtuse angle have the same degrees.

Further, the solar powered panel module includes a solar panel, a first fixing element, and a second fixing element, an end of the first fixing element is rotatably connected with and end of the solar panel, the other end of the first fixing element is connected with the first main board; an end of the second fixing element is rotatably connected with the other end of the solar panel, the other end of the second fixing element is connected with the first main board.

Further, each of the first fixing element and the second fixing element includes a first part configured to be disposed on the first main board and a second part vertically connected with the first part and rotatably connected with the solar panel.

Further, the lighting module includes a third fixing element disposed on the second main board and a light rotatably connected with the third fixing element.

Further, the third fixing element includes a base board installed on the second main board, a first extending board connected with the base board, and a second extending board connected with the base board, the second extending board faces with the first extending board, and two opposite sides of the light are rotatably connected with the first extending board and the second extending board respectively.

The present disclosure has the beneficial effects: by means of the above structure, the at least one connection portion can connect between the first mounting portion and the second mounting portion, such that the first mounting portion and the second mounting portion can clamp the pole to fix the solar powered light on the pole (such as a flagpole, a tree trunk, a telegraph pole, or other poles) stably.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
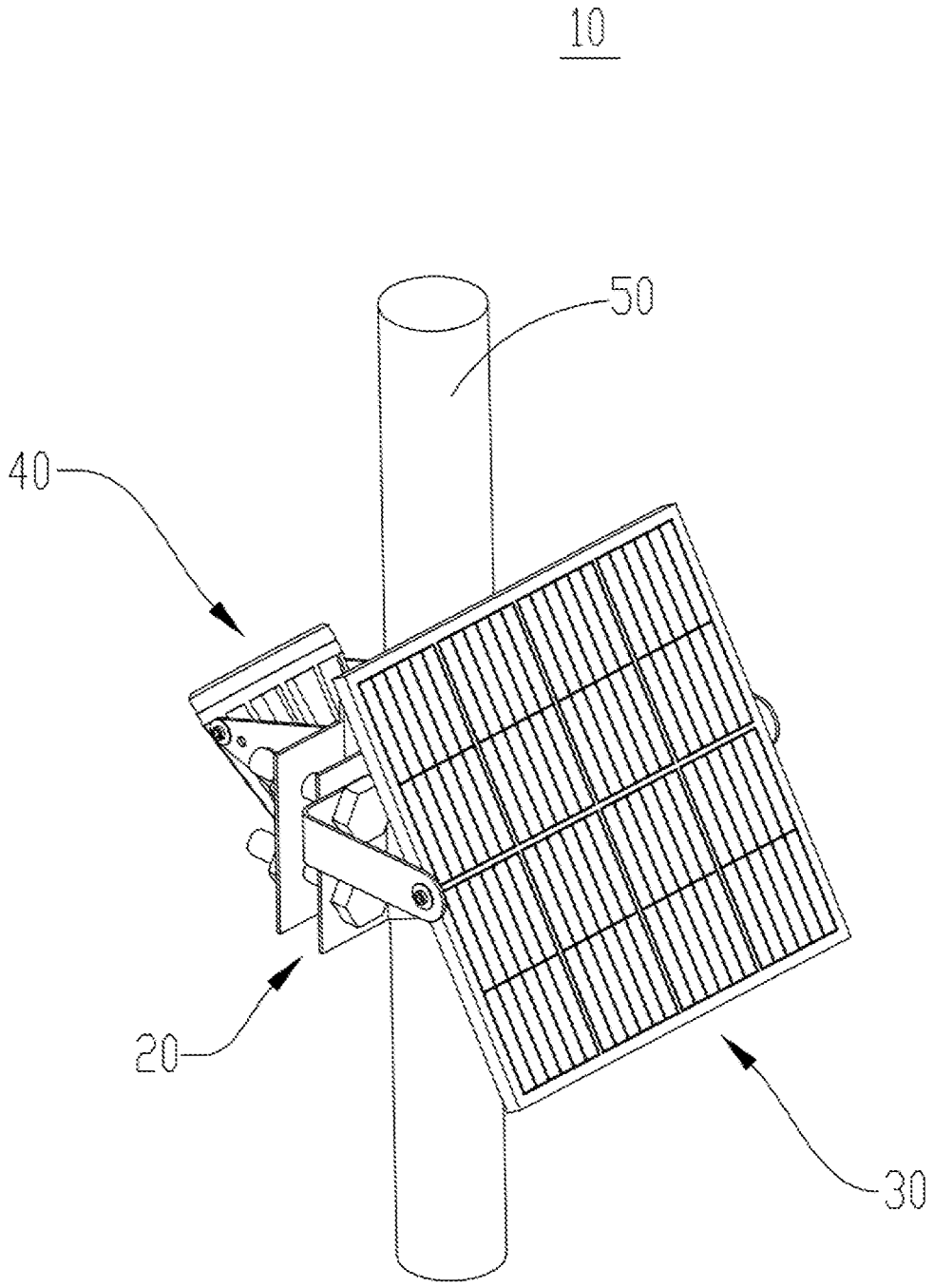
FIG. 1 is a schematic view of a solar powered flag light according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Figure 2:
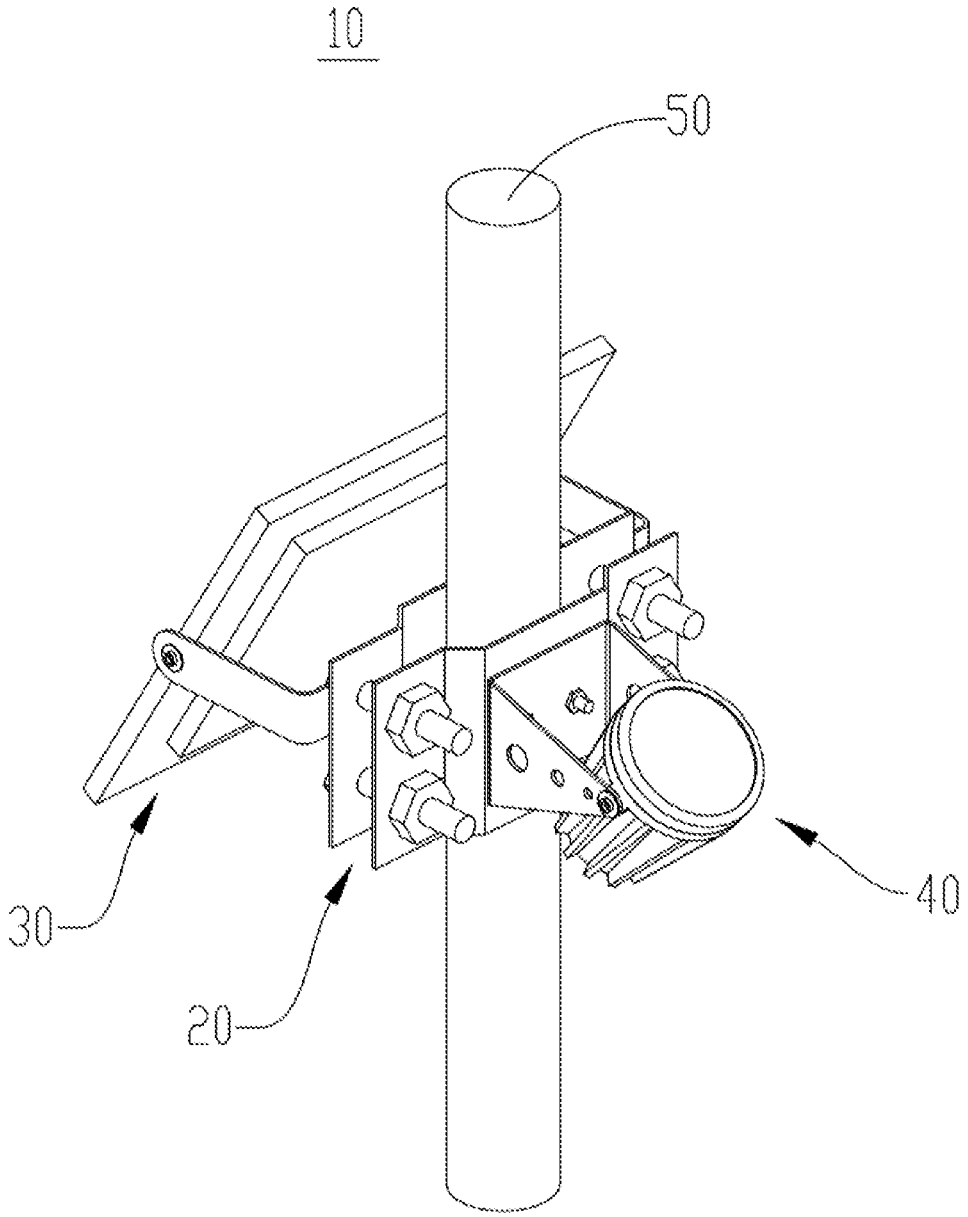
FIG. 2 is another schematic view of the solar powered flag light of FIG. 1.
Figure 3:
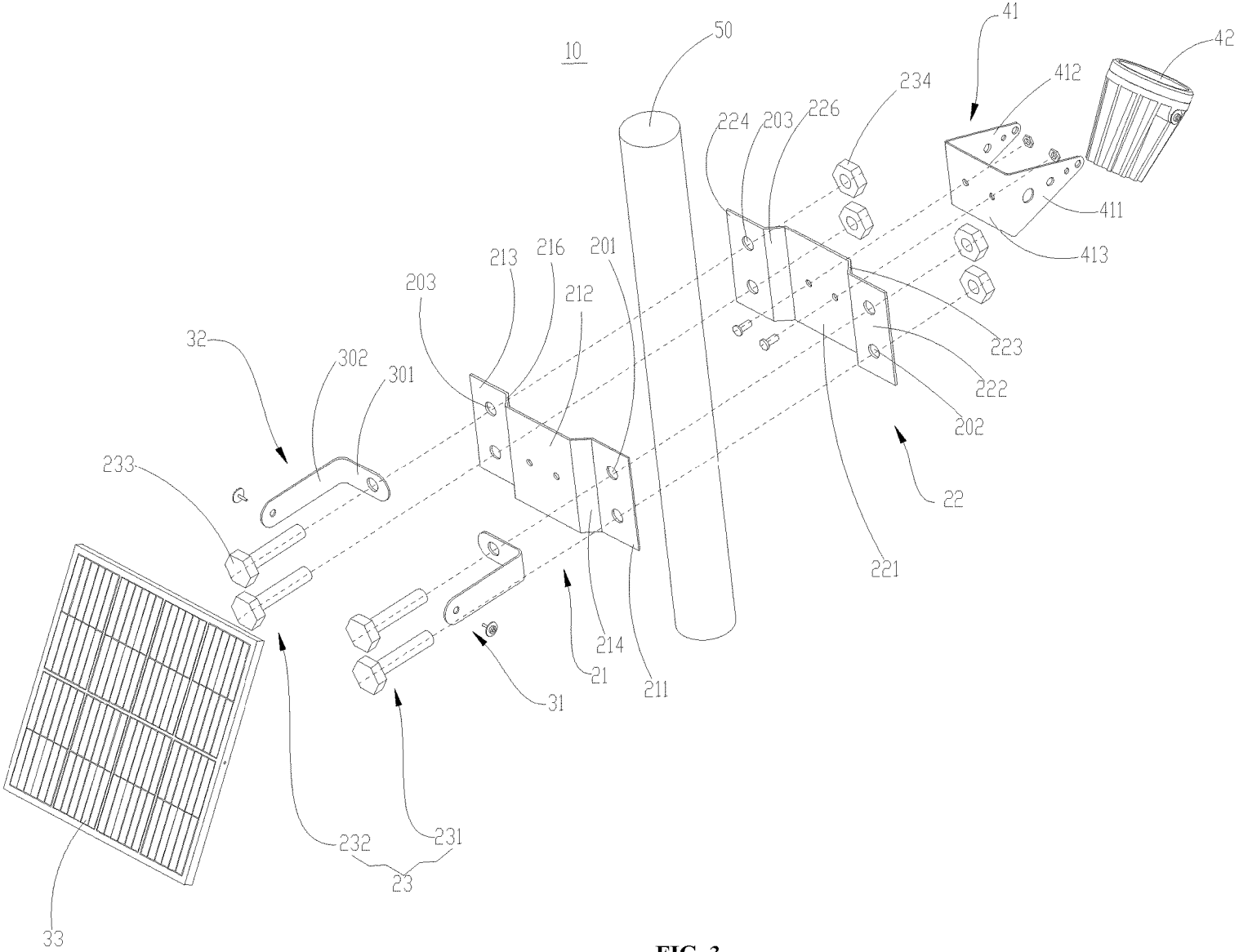
FIG. 3 is an exposed view of the solar powered flag light of FIG. 1.

Referring to FIG. 1 to FIG. 3, a solar powered flag light 10 includes a fixing module 20, a solar powered panel module 30 and a lighting module 40. The fixing module 20 includes a first mounting portion 21, a second mounting portion 22, and at least one connection portion 23. The first mounting portion 21 and the second mounting portion 22 are configured to be disposed on two opposite sides of a flagpole 50. The at least one connection portion 23 is configured to connect between the first mounting portion 21 and the second mounting portion 22, such that the first mounting portion 21 and the second mounting portion 22 can clamp the flagpole 50 to fix the solar powered flag light 10 on the flagpole 50.

The solar powered panel module 30 is configured to be disposed on the first mounting portion 21.

The lighting module 40 is configured to be disposed on the second mounting portion 22.

Figure 4:
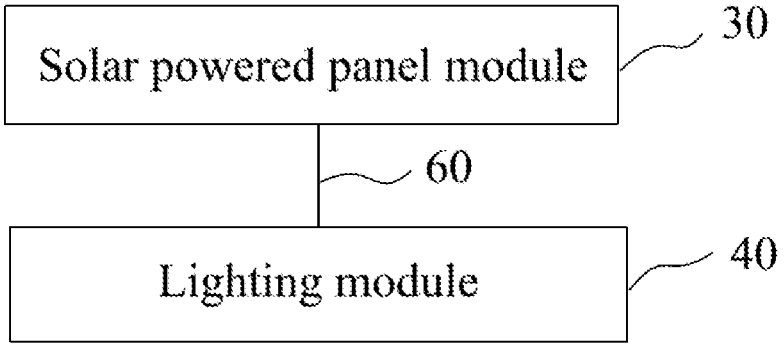
FIG. 4 is a circuit block diagram of the solar powered flag light of FIG. 1.

Referring to FIG. 4, it can be understood, the lighting module 40 is electrically connected to the solar powered panel module 30 via an electricity line 60, such that the solar powered panel module 30 can supply the lighting module 40.

The at least one connection portion 23 includes at least one first connection portion 231 and at least one second connection portion 232. The at least one first connection portion 231 is configured to connect a first end 211 of the first mounting portion 21 and a second end 222 of the second mounting portion 22. The at least one second connection portion 232 is configured to connect a third end 213 of the first mounting portion 21 opposite to the first end 211 and a fourth end 225 of the second mounting portion 22 opposite to the second end 222, such that the flagpole 50 is located between the at least one first connection portion 231 and the at least one second connection portion 232.

Each of the at least one first connection portion 231 and the at least one second connection portion 232 includes a screw 233 and a nut 234. The first mounting portion 21 includes a first through hole 201 located at the first end 211 and a third through hole 203 located at the third end 213. The second mounting portion 22 includes a second through hole 202 located at the second end 222 and a fourth through hole 204 located at the fourth end 224. The screw 233 of the at least one first connection portion 231 is configured to pass through the first through hole 201 and the second through hole 202, and the nut 234 of the at least one first connection portion 231 is configured to fixed at an end the screw 233 of the at least one first connection portion 231. The screw 233 of the at least one second connection portion 232 is configured to pass through the third through hole 203 and the fourth through hole 204. The nut 204 of the at least one second connection portion 232 is configured to fixed at an end the screw 233 of the at least one second connection portion 232. In the embodiment, a number of the at least one first connection portion 231 is two, and a number of the at least one second connection portion 232 is two.

The first mounting portion 21 includes a first main board 212, a first connection board 214 connected between the first end 211 and the first main board 212, and a second connection board 216 connected between the third end 213 and the first main board 212. The second mounting portion 22 includes a second main board 221 configured to face with the first main board 212, a third connection board 223 connected between the second end 222 and the second main board 221, and a fourth connection board 226 connected between the fourth end 224 and the second main board 221. A first distance between the first end 211 and the second end 222 is configured to be less than a distance between the first main board 212 and the second main board 221, a second distance between the third end 213 and the fourth end 224 is configured to be less than the distance between the first main board 212 and the second main board 221 and be equal to the first distance.

An angle between the first main board 212 and the first connection board 214 is a first obtuse angle, an angle between the first main board 212 and the second connection board 216 is a second obtuse angle, an angle between the first end 211 and the first connection board 214 is a third obtuse angle, an angle between the third end 213 and the first connection board 212 is a fourth obtuse angle, an angle between the second main board 221 and the third connection board 223 is a fifth obtuse angle, an angle between the second main board 221 and the fourth connection board 226 is a sixth obtuse angle, an angle between the second end 222 and the third connection board 223 is a seventh obtuse angle, an angle between the fourth end 224 and the fourth connection board 226 is an eighth obtuse angle, the first, second, third, fourth, fifth, sixth, seventh, and eighth obtuse angle have the same degrees.

The solar powered panel module 30 includes a first fixing element 31, a second fixing element 32, and a solar panel 33. An end of the first fixing element 31 is rotatably connected with and end of the solar panel 33, the other end of the first fixing element 31 is connected with and fixed on the first main board 212. An end of the second fixing element 32 is rotatably connected with the other end of the solar panel 33, the other end of the second fixing element 32 is connected with and fixed on the first main board 212.

Each of the first fixing element 31 and the second fixing element 32 includes a first part 301 configured to be disposed on the first main board 212 and a second part 302 vertically connected with the first part 301 and rotatably connected with the solar panel 33.

The lighting module 40 includes a third fixing element 41 disposed on the second main board 221 and a light 42 rotatably connected with the third fixing element 41.

The third fixing element 41 includes a base board 413 installed on the second main board 221, a first extending board 411 vertically connected with the base board 413, and a second extending board 412 vertically connected with the base board 413. The second extending board 412 faces with the first extending board 411, and two opposite sides of a housing of the light 42 are rotatably connected with the first extending board 411 and the second extending board 412 respectively.

By means of the above structure, the at least one connection portion 23 can connect between the first mounting portion 21 and the second mounting portion 22, such that the first mounting portion 21 and the second mounting portion 22 can clamp the flagpole 50 to fix the solar powered flag light 10 on the flagpole 50 stably.

The above description only describes embodiments of the present disclosure, and is not intended to limit the present disclosure, various modifications and changes can be made to the present disclosure. Any modifications, equivalent substitutions, improvements, etc. made within the spirit and scope of the present disclosure are intended to be included within the scope of the present disclosure.

What is claimed is:

1. A solar powered flag light, comprising a fixing module comprising a first mounting portion, a second mounting portion, and at least one connection portion, the first mounting portion and the second mounting portion configured to be disposed on two opposite sides of a flagpole, and the at least one connection portion configured to connect between the first mounting portion and the second mounting portion such that the first mounting portion and the second mounting portion clamp the flagpole to fix the solar powered flag light on the flagpole;

a solar powered panel module configured to be disposed on the first mounting portion; and a lighting module configured to be disposed on the second mounting portion, wherein the at least one connection portion comprises at least one first connection portion and at least one second connection portion, the at least one first connection portion is configured to connect a first end of the first mounting portion and a second end of the second mounting portion, the at least one second connection portion is configured to connect a third end of the first mounting portion opposite to the first end and a fourth end of the second mounting portion opposite to the second end, such that the flagpole is located between the at least one first connection portion and the at least one second connection portion, the first mounting portion comprises a first main board, a first connection board connected between the first end and the first main board, and a second connection board connected between the third end and the first main board, the solar powered panel module comprises a solar panel, a first fixing element, and a second fixing element, an end of the first fixing element is rotatably connected with and the end of the solar panel, the other end of the first fixing element is connected with the first main board; an end of the second fixing element is rotatably connected with the other end of the solar panel, the other end of the second fixing element is connected with the first main board.

2. The solar powered flag light according to claim 1, wherein each of the at least one first connection portion and the at least one second connection portion comprises a screw and a nut, the first mounting portion comprises a first through hole located at the first end and a third through hole located at the third end, the second mounting portion comprises a second through hole located at the second end and a fourth through hole located at the fourth end, the screw of the at least one first connection portion is configured to pass through the first through hole and the second through hole, and the nut of the at least one first connection portion is configured to fixed at an end the screw of the at least one first connection portion; the screw of the at least one second connection portion is configured to pass through the third through hole and the fourth through hole, and the nut of the at least one second connection portion is configured to fixed at an end the screw of the at least one second connection portion.

3. The solar powered flag light according to claim 2, wherein a number of the at least one first connection portion is two, and a number of the at least one second connection portion is two.

4. The solar powered flag light according to claim 2, wherein the second mounting portion comprises a second main board configured to face with the first main board, a third connection board connected between the second end and the second main board, and a fourth connection board connected between the fourth end and the second main board, a first distance between the first end and the second end is configured to be less than a distance between the first main board and the second main board, a second distance between the third end and the fourth end is configured to be less than the distance between the first main board and the second main board and be equal to the first distance.

5. The solar powered flag light according to claim 4, wherein an angle between the first main board and the first connection board is a first obtuse angle, an angle between the first main board and the second connection board is a second obtuse angle, an angle between the first end and the first connection board is a third obtuse angle, an angle between the third end and the first connection board is a fourth obtuse angle, an angle between the second main board and the third connection board is a fifth obtuse angle, an angle between the second main board and the fourth connection board is a sixth obtuse angle, an angle between the second end and the third connection board is a seventh obtuse angle, an angle between the fourth end and the fourth connection board is an eighth obtuse angle, the first, second, third, fourth, fifth, sixth, seventh, and eighth obtuse angle have the same degrees.

6. The solar powered flag light according to claim 1, wherein each of the first fixing element and the second fixing element comprises a first part configured to be disposed on the first main board and a second part vertically connected with the first part and rotatably connected with the solar panel.

7. The solar powered flag light according to claim 4, wherein the lighting module comprises a third fixing element disposed on the second main board and a light rotatably connected with the third fixing element.

8. The solar powered flag light according to claim 7, wherein the third fixing element comprises a base board installed on the second main board, a first extending board connected with the base board, and a second extending board connected with the base board, the second extending board faces with the first extending board, and two opposite sides of the light are rotatably connected with the first extending board and the second extending board respectively.

9. A solar powered light, comprising a fixing module comprising a first mounting portion, a second mounting portion, and at least one connection portion, the first mounting portion and the second mounting portion configured to be disposed on two sides of a pole, and the at least one connection portion configured to connect between the first mounting portion and the second mounting portion such that the first mounting portion and the second mounting portion clamp the pole to fix the solar powered light on the pole;

a solar powered panel module configured to be mounted on the first mounting portion; and a lighting module configured to be mounted on the second mounting portion, wherein the at least one connection portion comprises at least one first connection portion and at least one second connection portion, the at least one first connection portion is configured to connect a first end of the first mounting portion and a second end of the second mounting portion, the at least one second connection portion is configured to connect a third end of the first mounting portion opposite to the first end and a fourth end of the second mounting portion opposite to the second end, such that the pole is located between the at least one first connection portion and the at least one second connection portion, the first mounting portion comprises a first main board, a first connection board connected between the first end and the first main board, and a second connection board connected between the third end and the first main board, the second mounting portion comprises a second main board configured to face with the first main board, a third connection board connected between the second end and the second main board, and a fourth connection board connected between the fourth end and the second main board, the solar powered panel module comprises a solar panel, a first fixing element, and a second fixing element, an end of the first fixing element is rotatably connected with and end of the solar panel, the other end of the first fixing element is connected with the first main board; an end of the second fixing element is rotatably connected with the other end of the solar panel, the other end of the second fixing element is connected with the first main board, the lighting module comprises a third fixing element disposed on the second main board and a light rotatably connected with the third fixing element.

10. The solar powered light according to claim 9, wherein each of the at least one first connection portion and the at least one second connection portion comprises a screw and a nut, the first mounting portion comprises a first through hole located at the first end and a third through hole located at the third end, the second mounting portion comprises a second through hole located at the second end and a fourth through hole located at the fourth end, the screw of the at least one first connection portion is configured to pass through the first through hole and the second through hole, and the nut of the at least one first connection portion is configured to fixed at an end the screw of the at least one first connection portion; the screw of the at least one second connection portion is configured to pass through the third through hole and the fourth through hole, and the nut of the at least one second connection portion is configured to fixed at an end the screw of the at least one second connection portion.

11. The solar powered light according to claim 10, wherein a number of the at least one first connection portion is two, and a number of the at least one second connection portion is two.

12. The solar powered light according to claim 10, wherein a first distance between the first end and the second end is configured to be less than a distance between the first main board and the second main board, a second distance between the third end and the fourth end is configured to be less than the distance between the first main board and the second main board and be equal to the first distance.

13. The solar powered light according to claim 12, wherein an angle between the first main board and the first connection board is a first obtuse angle, an angle between the first main board and the second connection board is a second obtuse angle, an angle between the first end and the first connection board is a third obtuse angle, an angle between the third end and the first connection board is a fourth obtuse angle, an angle between the second main board and the third connection board is a fifth obtuse angle, an angle between the second main board and the fourth connection board is a sixth obtuse angle, an angle between the second end and the third connection board is a seventh obtuse angle, an angle between the fourth end and the fourth connection board is an eighth obtuse angle, the first, second, third, fourth, fifth, sixth, seventh, and eighth obtuse angle have the same degrees.

14. The solar powered light according to claim 9, wherein each of the first fixing element and the second fixing element comprises a first part configured to be disposed on the first main board and a second part vertically connected with the first part and rotatably connected with the solar panel.

15. The solar powered light according to claim 9, wherein the third fixing element comprises a base board installed on the second main board, a first extending board connected with the base board, and a second extending board connected with the base board, the second extending board faces with the first extending board, and two opposite sides of the light are rotatably connected with the first extending board and the second extending board respectively.

16. A solar powered light, comprising a fixing module comprising a first mounting portion, a second mounting portion, and at least one connection portion, the first mounting portion and the second mounting portion configured to be disposed on two sides of a pole, and the at least one connection portion configured to connect between the first mounting portion and the second mounting portion such that the first mounting portion and the second mounting portion clamp the pole to fix the solar powered light on the pole;

a solar powered panel module configured to be mounted on the first mounting portion; and a lighting module configured to be mounted on the second mounting portion, wherein the at least one connection portion comprises at least one first connection portion and at least one second connection portion, the at least one first connection portion is configured to connect a first end of the first mounting portion and a second end of the second mounting portion, the at least one second connection portion is configured to connect a third end of the first mounting portion opposite to the first end and a fourth end of the second mounting portion opposite to the second end, such that the pole is located between the at least one first connection portion and the at least one second connection portion, the first mounting portion comprises a first main board, a first connection board connected between the first end and the first main board, and a second connection board connected between the third end and the first main board, the second mounting portion comprises a second main board configured to face with the first main board, a third connection board connected between the second end and the second main board, and a fourth connection board connected between the fourth end and the second main board, a first distance between the first end and the second end is configured to be less than a distance between the first main board and the second main board, a second distance between the third end and the fourth end is configured to be less than the distance between the first main board and the second main board and be equal to the first distance, an angle between the first main board and the first connection board is a first obtuse angle, an angle between the first main board and the second connection board is a second obtuse angle, an angle between the first end and the first connection board is a third obtuse angle, an angle between the third end and the first connection board is a fourth obtuse angle, an angle between the second main board and the third connection board is a fifth obtuse angle, an angle between the second main board and the fourth connection board is a sixth obtuse angle, an angle between the second end and the third connection board is a seventh obtuse angle, an angle between the fourth end and the fourth connection board is an eighth obtuse angle, the first, second, third, fourth, fifth, sixth, seventh, and eighth obtuse angle have the same degrees.

* * * * *